US005463964A

United States Patent [19]

Long et al.

[11] Patent Number: 5,463,964

[45] Date of Patent: Nov. 7, 1995

[54] ROCKER SEAT CONNECTION

[75] Inventors: Jack R. Long, St. Charles, Ill.; Hans B. Weber, Rotonda West, Fla.

[73] Assignee: National Castings Incorporated, Lisle, Ill.

[21] Appl. No.: 241,570

[22] Filed: May 12, 1994

[51] Int. Cl.[6] ..... B61F 5/00

[52] U.S. Cl. ..... 105/187; 105/208.1

[58] Field of Search ..... 105/187, 208, 105/208.1, 212

[56] References Cited

U.S. PATENT DOCUMENTS

| | | | |
|---|---|---|---|
| 648,030 | 4/1900 | Hubbard, Jr. | 105/187 |
| 1,057,990 | 4/1913 | Wilson | 105/187 |
| 3,670,660 | 6/1972 | Weber et al. | 105/208 X |
| 4,278,030 | 7/1981 | Ahlborn et al. | 105/208.1 |
| 5,027,716 | 7/1991 | Weber et al. | 105/208.1 X |

*Primary Examiner*—Matthew C. Graham
*Assistant Examiner*—Kevin D. Rutherford

[57] ABSTRACT

A railroad car truck or bogie is described as having a pair of sideframes between which are mounted a bolster and either a transom or pair of tie rods which, in turn, are attached to a pair of rocker seats which extend into the sideframes and over open, U-shaped channels that are formed in the sideframes midway between the opposing ends of the sideframes. A pair of hardened steel bearings are maintained in spaced coaxial relation in each of the channels. Each of the bearings has at least a parti-cylindrical head which extends in the direction of the adjacent, juxtaposed rocker seat which is provided with a vertically aligned, matingly curved recess for receiving the head of the adjacent bearing. The recesses have a larger radius of curvature to facilitate relative rocking motion between the rocker seats and bearings. Means are provided for limiting the rocking motion between the rocker seats and bearings. Also described is a unique rigid connection between the ends of the tie rods and the rocker seats.

21 Claims, 3 Drawing Sheets

ROCKER SEAT CONNECTION

BACKGROUND OF THE INVENTION

The invention relates to railroad car trucks or bogies. More particularly, the invention is in relation to a railroad car truck which is manufactured and sold by National Castings Incorporated of Lisle, Ill. under the trademark SWING MOTION. A detailed description of this quality, heavy duty truck with excellent high speed performance characteristics is found in U.S. Pat. No. 3,670,660 which is made a part hereof.

The SWING MOTION truck is manufactured from many different steel parts, such as a bolster and transom which are coupled transversely between a pair of parallel sideframes between which a pair of axles with attached wheels are mounted for rotation. The transom is generally parallel to the bolster, but in closer spaced relation to the railroad trackway, when the truck is mounted on the trackway. The transom has a pair of opposing ends which are mounted, e.g. bolted, on similar rocker seats, each of which seats comprises a rectangular plate with a semi-cylindrical projection or head that extends from the plate towards the trackway and rests in supported relation on a pair of coaxially spaced, hardened, U-shaped rocker seat bearings which are restricted for movement in open, slightly larger, rectangular channels that are formed in the sideframes below the connection of the bolster ends with the sideframes.

The current configuration of the SWING MOTION truck, including the present, bolted transom and bearing arrangement, has demonstrated a high degree of performance in terms of high speed stability and low maintenance costs. Recent tests for inter-axle shear stiffness (IASS) have shown that this bolted transom arrangement contributes significantly to the IASS, which is a major factor in high speed stability and improved wheel wear.

Further improvement in IASS can be achieved through the invention which is in a different rocker seat and bearing assembly which solves shortcomings of the current arrangement relating to, I) potential wear or lock up of the arrangement in adverse, particularly sandy environments, and II) the problems of maintaining the proper clearance between the transom, rocker seat, and sideframe.

Briefly stated, the invention is in a rocker seat which includes at least one inwardly directed, recess which is at least parti-cylindrical, in shape, and which is transversely disposed to the longitudinal axis of the transom. Each recess is designed to receive a matingly curved head which protrudes from an adjacent, vertically aligned, hardened steel bearing which is disposed in stationary relation within a slightly larger channel that is formed in the adjacent sideframe. The at least parti-cylindrical heads of the bearings are generated by a radius which is slightly smaller than the radius used in the formation of the at least parti-cylindrical recesses in the rocker seats, to facilitate relative rocking motion between the sideframes and the rocker seats and attached transom which can be replaced by a plurality of tie rods without detracting from the invention.

DESCRIPTION OF THE DRAWING

The following description of the invention will be better understood by having reference to the accompanying drawing, wherein.

DETAILED DESCRIPTION OF THE DRAWING

Figure 1:
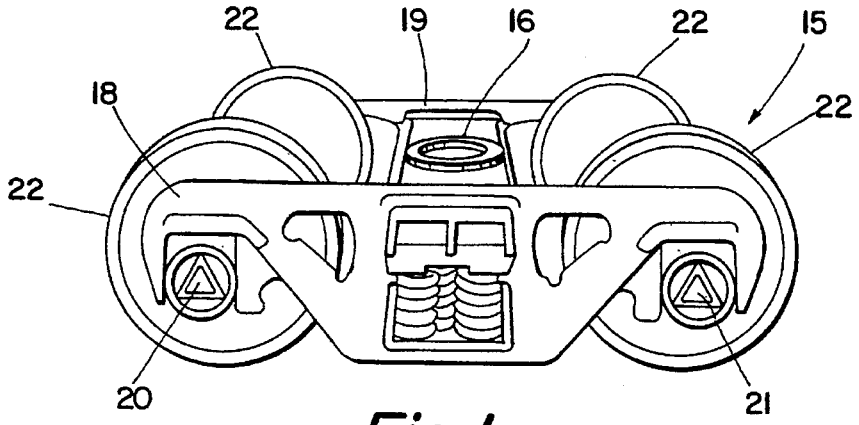
Fig. 1 (PRIOR ART)
FIG. 1 is a perspective view of a SWING MOTION truck or bogie.
Figure 2:
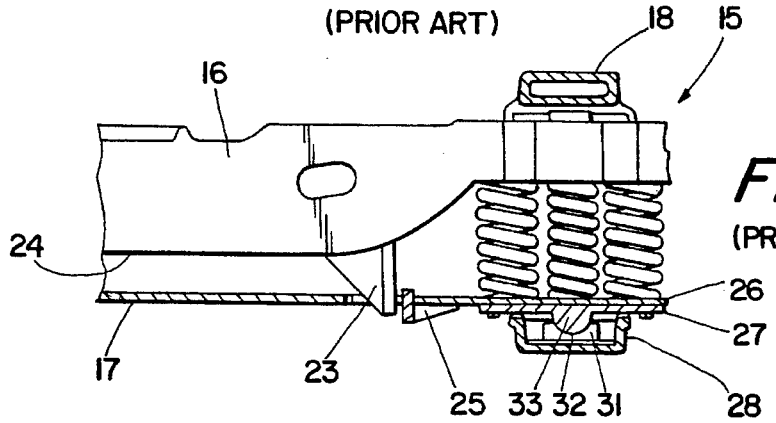
Fig. 2 (PRIOR ART)
FIG. 2 is a transverse view of a portion of the truck, designed to show one-half of the bolster, and one-half of the transom and parts of a sideframe, in section, and particularly show the connection of the transom with a rocker seat which is supported on at least one hardened steel bearing that is disposed in the open, U-shaped channel of a sideframe.

With general reference to the drawing for like parts, and specific reference to FIGS. 1 and 2, there is shown an existing SWING MOTION truck 15 which essentially comprises a bolster 16 and transom 17 which are coupled in transverse, parallel relation between a pair of sideframes 18 and 19 between which a pair of axles 20 and 21 with attached wheels 22 are journaled for rotation. A pair of similar, but oppositely disposed stops 23 are longitudinally spaced on the underside 24 of the bolster 16 and extend therefrom in a direction towards the transom 17 for engaging a pair of farther, longitudinally spaced abutments 25 which are carried by the transom 17 to limit relative axial movement between the bolster 16 and transom 17.

Figure 5:
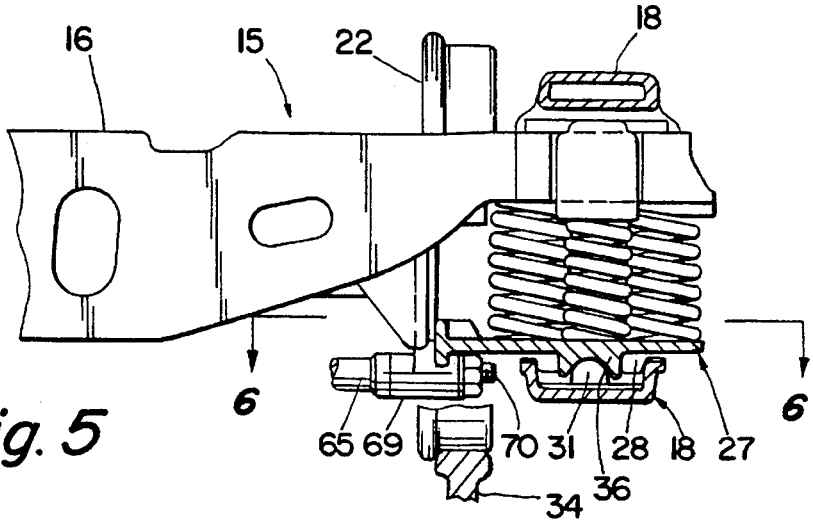
FIG. 5 is similar to FIG. 2, but shows the use of a pair of tie rods which are rigidly connected to the rocker seats in place of a transom.
Figure 6:
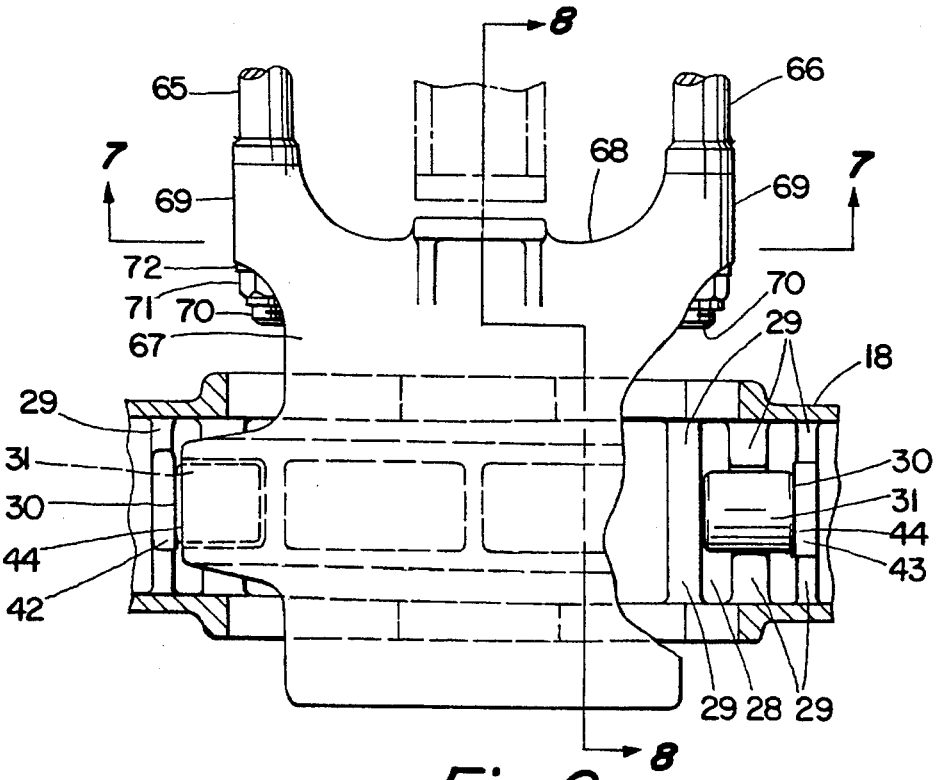
FIG. 6 is a plan view seen from the line 6—6 of FIG. 5, and is designed to show one-half of the rocker seat and the channel in a sideframe to better understand how the bearings are maintained, in position, within each of the channels.
Figure 7:
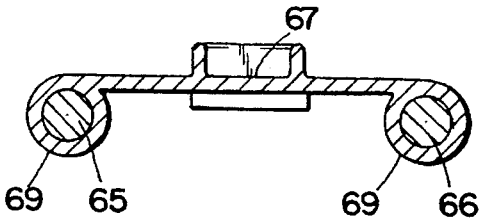
FIG. 7 is a section of tie rods and connecting plate of the rocker seat viewed from the line 7—7 of FIG. 6.
Figure 8:
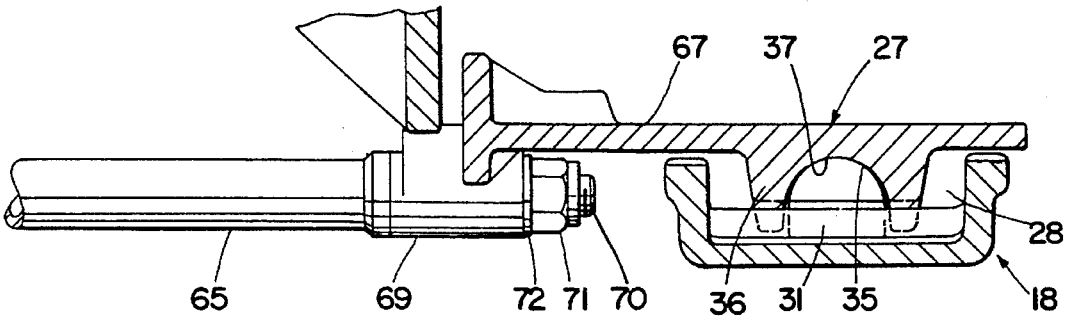
FIG. 8 is a section of a rocker seat and bearing of the invention viewed from the line 8—8 of FIG. 6.
Figure 9:
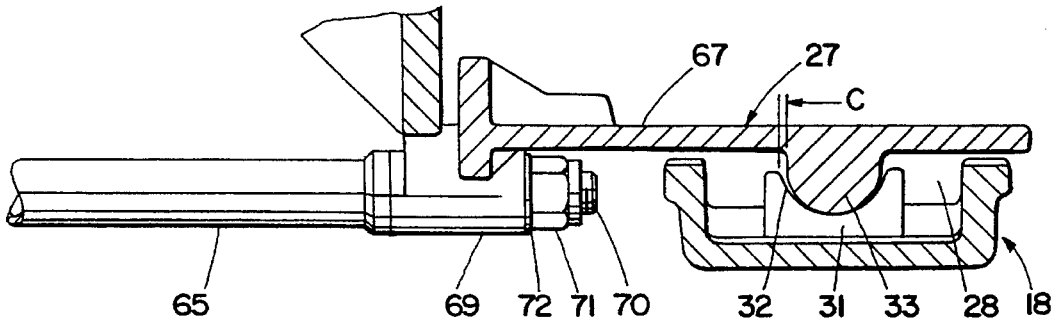
FIG. 9 is a section, similar to FIG. 8, and shows a similar connection between the tie rods and a rocker seat which is conventionally supported on an existing hardened steel bearing in a sideframe channel.

The transom 17 has a pair of similar, opposing ends 26, each of which is mounted on a rocker seat 27 which, in turn, is mounted for relative rocking motion in an open, U-shaped channel 28 which is formed in each of the sideframes 18 and 19, midway between the opposing ends of the sideframes, by any suitable means. For example, as best seen in FIG. 6, a number of upstanding lugs 29 are integrally formed in each of the channels 28 to form, in essence, a pair of similar, rectangularly shaped sockets 30 which are longitudinally spaced in each one of the channels 28. Each one of the sockets 30 is designed to receive a hardened steel bearing 31 with a semi-cylindrical recess 32 which opens upwardly from the channel 28 in a direction towards the transom 17 for receiving a vertically aligned arid correspondingly shaped, semi-cylindrical head 33 that is formed in each one of the rocker seats 27 and protrudes therefrom in a direction towards an adjacent horizontal trackway 34 (FIG. 5) on which the truck 15 is assumed to rest for purposes of this explanation and following description of the invention. The radius of curvature of each one of the rocker seat heads 33 is slightly smaller than that of each one of the bearing recesses 32, such that the clearance C between the upper marginal edges of the bearing recesses 32 and the adjacent heads 33 of the rocker seats 27, as best seen in FIG. 9, is in the range of from about 3/16 inches to about ¼ inches, to permit relative rocking motion between the rocker seats 27 and sideframes 18 and 19. The connection between the rocker seats 27 and transom 17 may be rigid or semi-rigid, depending on the result desired. For example, the free ends 26 of the transom 17 can be bolted to the rocker seats 27, as shown in FIG. 2, or they can be provided with a plurality of holes for receiving truncated lugs or dowels extending from the rocker seats 27, as has been practiced in the past. It can be appreciated from a study of FIG. 2, that dirt or gravel from the roadbed of a trackway 34 (FIG. 5) can easily enter the upwardly facing recesses 32 in the twin bearings 31, to contact and wear the protruding, softer steel heads 33 of each one of the rocker seats 27. The following described invention is designed to overcome this problem.

Figure 3:
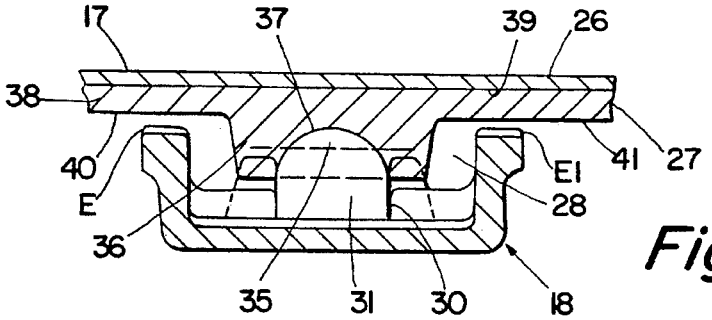
FIG. 3 is an enlarged cross section of a rocker seat and bearing assembly which is highly improved and made in accordance with the invention.

With reference to FIGS. 3 and 6, there is shown a pair of similar, rectangular hardened steel bearings 31 which are positioned in the longitudinally spaced sockets 30 which are formed in the channels 28 of the sideframes 18 and 19. In this case, however, each one of the bearings 31 is provided with a semi-cylindrical head 35 which extends outwardly from the channel 28 into supporting relation with the adjacent, juxtaposed rocker seat 27 and attached transom end 26. The rocker seats 27 of the invention are each designed to accommodate the twin heads 35 of the two adjacent bearings 31 by providing each one of them with a continuous, or at least one pair of similar, inverted U-shaped bodies 36 which are vertically aligned with the bearings 31, when the railroad car truck 17 is in a horizontal position. Each one of the rocker seat bodies 36, when viewed from the side, as seen in FIG. 3, resembles a bridge which has a pair of piers that are separated by an arch which, in this case, is a semi-cylindrical recess 37 which is designed to receive an adjacent bearing head 35. The radius of curvature of each one of the bearing heads 35 is slightly smaller than that of the abutting, rocker seat recess 37, so as not to impede rocking motion of the rocker seats 27 relative to the sideframes 18 and 19. The aforementioned clearance C, in this case between the free, distal or marginal edges of the inverted U-shaped rocker seat bodies 36 and adjacent bearing heads 35 is in the range of from about 1/16 inches to about ⅛ inches, which is roughly about ⅛ inches tighter than the clearance presently used. The at least two, identical rocker seat bodies 36, are longitudinally spaced and aligned, and extend from, a wider and longer plate 38 which has a flat upper surface 39 for abutting the adjacent transom end 26, and a pair of lower, flat bottom surfaces 40 and 41 which are in the same plane and parallel to the upper surface 39. The rocker seat plates 38 overlap and engage adjacent upper marginal edges E and E1 of the channels 28 to limit relative rocking motion between the rocker seats 27 and bearings 31. The ribs 42 and 43 at the farthest longitudinally spaced, opposing ends of the sockets 30 (FIG. 6) are designed to engage the adjacent ends 44 of the rocker seat bodies 36 to limit or restrict movement of the rocker seats 27 longitudinally of the sideframe channels 28.

Figure 4:
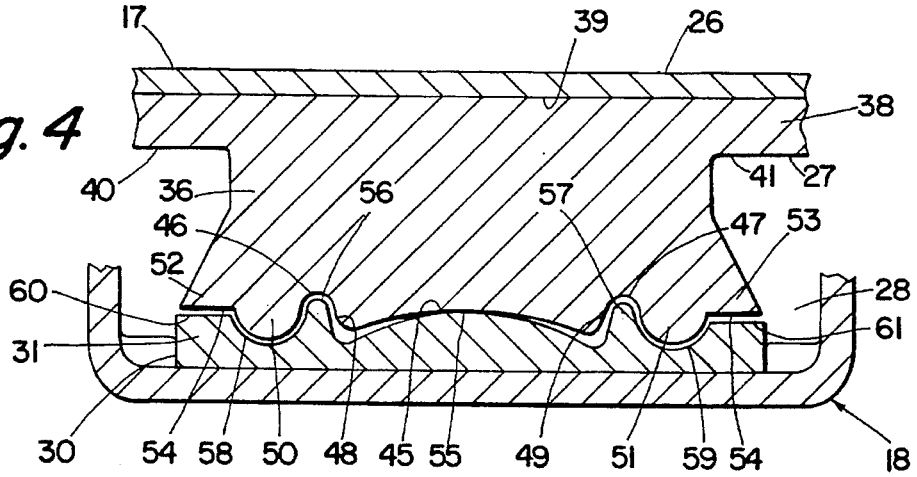
FIG. 4 is a similar cross section of another embodiment of a rocker seat and bearing assembly which is made in accordance with the invention.

With particular reference to FIG. 4, there is shown a different rocker seat body 36 and hardened steel bearing 31 which are specially contoured to prevent the infiltration of dirt and gravel between the contacting surfaces of these two components, while providing special means for limiting the aforementioned relative rocking motion between the rocker seat 27 and bearing 31. The at least one rocker seat body 36, shown in FIG. 4, has a much shallower, parti-cylindrical recess 45 which is formed on a much larger radius of curvature, as seen when compared with FIG. 3. A pair of slots 46 and 47 are disposed in the rocker seat body 36 along opposing marginal edges 48 and 49 of the recess 45, and extend inwardly of the body 36 in a direction towards the transom end 26. A pair of bulbous portions 50 and 51, integrally formed with the body 36, are laterally spaced outwardly of the slots 46 and 47 and extend therealong outwardly in a direction away from the transom end 26. The rocker seat body 36 is also provided with a pair of triangular stops 52 and 53 which extend outwardly from the body 36 adjacent the bulbous portions 50 and 51. The stops 52 and 53 are integrally formed with the body 36, and have similar, coplanar flat surfaces 54 which are parallel to the upper flat surface 39 of the rocker seat body 36. The confronting surfaces of the rocker seat body 36 and bearing 31 are substantially, matingly contoured.

For example, the bearing 31 comprises: a parti-cylindrical head 55 for receipt in the parti-cylindrical rocker seat recess 45; a pair of upstanding ridges 56 and 57 which extend into the marginally disposed slots 46 and 47 in close proximity to the rocker seat body 36; a pair of relatively shallow grooves 58 and 59 for receiving the bulbous portions 50 and 51 of the rocker seat body 36, the grooves 58 and 59 terminating at a pair outwardly spaced, coplanar abutments 60 and 61 which are designed to contact the coplanar faces 54 of the stops 52 and 53 to limit the aforementioned relative rocking motion between the rocker seat 27 and bearing block 31. The slots 46,47, ridges 56,57, bulbous portions 50,51, and grooves 58,59, coact to form labyrinths to prevent particulate matter from getting between the parti-cylindrical recesses 45 and heads 55 of the rocker seats 27 and bearings 31, respectively. The radius of curvature of each one of the parti-cylindrical recesses 45 of the rocker seats 27 is greater than that of the parti-cylindrical heads 55 of the bearings 31 to facilitate relative rocking motion between the rocker seats 27 and bearings 31.

With particular reference to FIGS. 5–9, there is shown a railroad car truck or bogie 15 which is essentially the same as the aforementioned trucks, except that the solid, plate-shaped transom 17 is replaced by a pair of tie rods 65 and 66, as described in U.S. Pat. No. 5,027,716 which is made a part hereof. The tie rods 65 and 66 are rigidly connected to the rocker seat 27, contrary to the aforementioned patent, wherein a resilient elastomeric washer is used in the connection to provide, at most, a semi-rigid connection.

Such a rigid connection is achieved by using an enlarged, upper, rocker seat plate 67 which extends inwardly of the adjacent, attached sideframe, e.g. sideframe 18, in a direction towards the opposing sideframe, e.g. sideframe 19, and terminates at an inboard end 68 which is integrally formed with a pair of similar, rigid, hollow, cylindrical collars 69 extending longitudinally of the tie rods 65,66 and which are fastened around similar, threaded ends 70 of the tie rods 65 and 66, by any suitable means, e.g. nuts 71 and washers 72. Each one of the enlarged rocker seat plates 67 is provided with a pair of downwardly directed arched bridge-shaped bodies 36 with semi-cylindrical recesses 37 for supported relation on a pair of hardened steel bearings-31 with semi-cylindrical heads 35, as previously described and seen in FIGS. 3, 5 and 8. The aforementioned enlarged rocker seat plate 67 with attached twin collars 69 can be adapted to existing rocker seats 27 which have a pair of downwardly directed, semi-cylindrical heads 33 for supported relation in a pair of semi-cylindrical recesses 32 of a hardened steel bearings 31, as previously described and seen in FIGS. 2 and

9.

Figure 10:
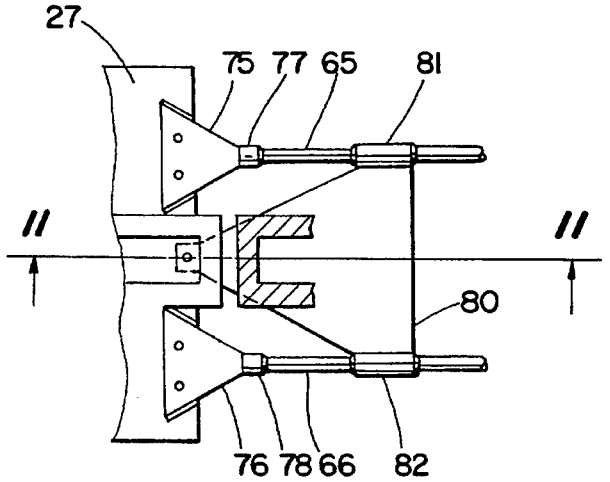
FIG. 10 is a plan view of another rigid connection between a pair of tie rods and a rocker seat.
Figure 11:
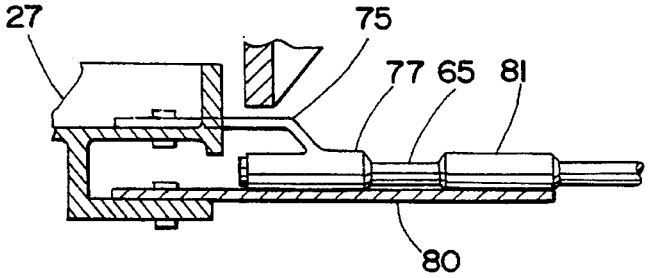
FIG. 11 is a side view of the rigid connection, as seen from the line 11—11 of FIG. 10.

With particular reference to FIGS. 10 and 11, there is shown another rigid connection between the tie rods 65 and 66 and the rocker seat 27. In this case, a pair of pie-shaped gusset plates 75 and 76 are integrally formed with, or welded to, a first pair of collars 77 and 78, which are similar to those previously described. The collars 77 and 78 and attached gusset plates 75 and 76 are then bolted and/or welded between the ends of the tie rods 65 and 66 and the adjacent rocker seats 27. The connection is further rigidified by using a third, pie-shaped gusset plate 80 which spans the distance between the tie rods 65 and 66, and which is integrally formed with, or welded to, a second pair of collars 81 and 82 which are welded around the tie rods 65 and 66 in spaced, axial relation from the first pair of collars 77 and 78 and smaller gusset plates 75 and 76. The larger gusset plate 80 is, likewise, bolted and/or welded to the rocker seat 27 between the smaller gusset plates 75 and 76. This provides a very rigid connection between the tie rods 65 and 66 and the rocker seats 27.

In either of the above cases, the rocker seats 27, which are attached to the tie rods 65 and 66, can be designed in accordance with the invention to include at least a pair of parti-cylindrical recesses 37 for receipt and supported relation on matingly shaped, parti-cylindrical heads 35 of a pair of hardened steel bearings 31. These same rocker seats 27 can also be adapted to include a pair of semi-cylindrical heads 33 for seated, supported relation in matingly shaped semi-cylindrical recesses 32 which are provided in a pair of hardened steel bearings 31, as seen in FIGS. 2 and 9.

Thus, there has been described a unique, rocker seat and bearing connection which can be used with a solid, plate-like transom, or a pair of parallel tie rods. Further, there is described a tie rod and rocker seat connection which is rigid and free of any elastomeric material which could detract from the rigidity of the connection.

What is claimed is:

1. A railroad car truck, comprising:

a) a pair of sideframes held in parallel relation by a bolster and at least one other member, which are separately coupled transversely between the sideframes, each of the sideframes including a U-shaped channel between opposing ends of the sideframe, the channels being open upwardly in a direction towards the bolster, when the truck is horizontally disposed, the at least one other member having a pair of opposing ends adjacent the open channels;

b) at least one upwardly facing socket formed in each of the channels;

c) a hardened steel bearing disposed in each one of the sockets for restricted movement therein, each one of the bearings including a pair of opposing sides and at least a parti-cylindrical head which is disposed between said sides and extends therefrom and the socket in a direction towards the bolster;

d) a rocker seat secured adjacent each of the opposing ends of the at least one member, the rocker seats covering the heads of the bearings and being supported thereon, each of the rocker seats, in cross-section, resembling a bridge having an arch between a pair of piers which extend from the arch in a direction away from the bolster and terminate alongside the bearing to engage the bearing and limit relative lateral movement between the bearing and rocker seat seated thereon, the arch including a matingly curved recess for receiving the at least parti-cylindrical head of an adjacent bearing, the radius of curvature of the recesses being greater than that of the heads to facilitate relative rocking motion between the rocker seats and bearings; and e) means for limiting the relative rocking motion between the rocker seats and bearings.

2. The railroad car truck of claim 1, wherein the heads of the bearings are semicylindrical.

3. The railroad car truck of claim 2, wherein each one of the channels includes a pair of sockets which are axially aligned in longitudinally spaced relation in the channel, and a pair of identically shaped bearings are disposed in the sockets, and each one of the rocker seats includes a pair of matingly curved recesses for receiving the heads of the two bearings.

4. The railroad car truck of claim 3, wherein each one of the rocker seat recesses are formed in a generally rectangular rocker seat body which extends into an adjacent channel.

5. The railroad car truck of claim 4, wherein the pair of sockets which are formed in each one of the channels, includes a pair longitudinally spaced ribs which project from the sockets for engaging adjacent rocker seat bodies to limit movement of the rocker seats longitudinally of the channels.

6. A railroad car truck, comprising:

a) a pair of sideframes held in parallel relation by a bolster and at least one other member, which are separately coupled transversely between the sideframes, each of the sideframes including a U-shaped channel between opposing ends of the sideframe, the channels being open upwardly in a direction towards the bolster, when the truck is horizontally disposed;

b) a pair of upwardly facing sockets disposed in each of the channels in axially aligned and longitudinally spaced relation, each pair of sockets including a pair of longitudinally spaced ribs which project from the sockets for engaging adjacent rocker bodies to limit movement of the rocker seats longitudinally of the channels;

c) a hardened steel bearing disposed in each one of the sockets for restricted movement therein, each one of the bearings including at least a parti-cylindrical head which extends from the socket in a direction towards the bolster;

d) a rocker seat secured to opposing ends of the at least one member adjacent the sideframes, the rocker seats covering the bearings and being supported thereon, each of the rocker seats including a pair of matingly curved recesses for receiving the at least parti-cylindrical head of an adjacent bearing, each one of the recesses being formed in a generally rectangular rocker seat body which extends into an adjacent channel and includes a pair of slots adjacent parallel, opposing marginal edges of the recesses for receiving a pair of matingly shaped ridges which are integrally formed in the bearings adjacent opposing marginal edges of the at least parti-cylindrical head of the adjacent bearing, the radius of curvature of the heads and recesses being such as to facilitate relative rocking motion between the rocker seats and bearings; and e) means for limiting the relative rocking motion between the rocker seats and bearings.

7. The railroad car truck of claims 1 or 6, wherein the at least one member which is transversely disposed between the sideframes, includes a pair of metal tie rods with opposing ends, and means for securing the opposing ends of the tie rods to the rocker seats.

8. The railroad car truck claim 7, wherein the means for securing opposing ends of the tie rods to the rocker seats includes a pair of rigid connections which are free of elastomeric material.

9. The railroad car truck of claim 8, wherein each one of the rigid connections between the tie rods and rocker seats includes, a pair of hollow, cylindrical collars secured around a pair of tie rod ends adjacent each one of the sideframes, and means for securing an adjacent rocker seat to each pair of adjacent collars.

10. The railroad car truck of claim 9, wherein the means for securing a rocker seat to a pair of adjacent collars includes a pair of gusset plates rigidly secured between the rocker seat and the adjacent pair of collars.

11. The railroad car truck of claim 10, wherein the means for securing opposing ends of the tie rods to the rocker seats includes, a second pair of hollow cylindrical collars secured to the tie rods in axial spaced relation from each one of the other pairs of tie rods and adjacent rocker seat, and a third gusset plate secured to each one of the second pairs of collars and spanning the distance therebetween, the third gusset plates rigidly secured to the adjacent rocker seat between the other pair of gusset plates.

12. The railroad car truck of claim 9, wherein the means for securing a rocker seat to an adjacent pair of collars includes integrally forming each rocker seat with the adjacent pair of collars.

13. The railroad car truck of claim 6, wherein each one of the rocker seat bodies includes, a pair of bulbous portions adjacent the slots and spaced outwardly thereof for receipt in a pair of grooves formed in the adjacent bearing adjacent the ridges thereof, the slots and ridges together with the grooves and bulbous portions forming labyrinths adjacent the recesses to prevent particulate matter from entering the rocker seat recesses and contacting the at least parti-cylindrical bearing heads.

14. The railroad car truck of claim 13, wherein the means (e) for limiting rocking motion between the rocker seats and bearings, includes a pair of stops carried by each rocker seat body adjacent the bulbous portions and spaced outwardly therefrom, the stops including a pair of coplanar surfaces for engaging adjacent coplanar abutments formed in the adjacent bearing outwardly adjacent the grooves therein.

15. The railroad car truck of claims 1 or 6, wherein the at least one member which is transversely disposed between the sideframes, is a generally solid, plate-like transom with means for limiting relative axial movement between the transom and bolster.

16. A railroad car truck, comprising:

a) a pair of sideframes, each of which includes a U-shaped channel disposed between opposing ends of the sideframe;

b) a pair of tie rods and juxtaposed bolster disposed in generally parallel relation between the sideframes for holding the sideframes in parallel relation while allowing relative movement between the sideframes, bolster and pair of tie rods which have a pair of opposing ends which terminated adjacent each of the sideframes;

c) a pair of rocker seats disposed at the opposing ends of the tie rods and extending into the sideframes above the open channels in the sideframes when the sideframes are horizontally disposed;

d) rigid means, free of any elastomeric material and integral with the rocker seats, extending longitudinally of the tie rods, for rigidly connecting the rocker seats to adjacent ends of the tie rods: and e) means disposed in each channel and coacting with an adjacent rocker seat for keeping the adjacent rocker seat in position above the channel while allowing relative rocking motion between the rocker seats and sideframes.

17. A railroad car truck, comprising:

a) a pair of sideframes, each of which includes a U-shaped channel disposed between opposing ends of the sideframe;

b) a pair of tie rods and juxtaposed bolster disposed in generally parallel relation between the sideframes for holding the sideframes in parallel relation while allowing relative movement between the sideframes, bolster and pair of tie rods which have a pair of opposing ends which terminated adjacent each of the sideframes;

c) a pair of rocker seats disposed at the opposing ends of the tie rods and extending into the sideframes above the open channels in the sideframes when the sideframes are horizontally disposed;

d) means for rigidly connecting the rocker seats to adjacent ends of the tie rods, said means including:

i) a pair of rigid, hollow, cylindrical collars integral with each one of the pair of rocker seats; and ii) means for securing each pair of collars in surrounding relation around adjacent ends of the tie rods; and e) means disposed in each channel and coacting with an adjacent rocker seat for keeping the adjacent rocker seat in position above the channel while allowing relative rocking motion between the rocker seats and sideframes.

18. A railroad car truck, comprising:

a) a pair of sideframes, each of which includes a U-shaped channel disposed between opposing ends of the sideframe;

b) a pair of tie rods and juxtaposed bolster disposed in generally parallel relation between the sideframes for holding the sideframes in parallel relation while allowing relative movement between the sideframes, bolster and pair of tie rods which have a pair of opposing ends which terminated adjacent each of the sideframes;

c) a pair of rocker seats disposed at the opposing ends of the tie rods and extending into the sideframes above the open channels in the sideframes when the sideframes are horizontally disposed;

d) means, free of any elastomeric material, for rigidly connecting the rocker seats to adjacent ends of the tie rods, said means including:

h) a pair of hollow, cylindrical collars secured to each pair od adjacent opposing ends of the tie rods; and j) means for rigidly connecting each of the rocker seats to an adjacent pair of collars; and e) means disposed in each channel and coacting with an adjacent rocker seat for keeping the adjacent rocker seat in position above the channel while allowing relative rocking motion between the rocker seats and sideframes, said rocker seat coacting means, including:

f) at least one hardened steel bearing disposed in each of the channels, the at least one bearing having at least a parti-cylindrical head which extends in a direction towards the adjacent rocker seat; and g) at least one matingly curved recess formed in the rocker seat for receiving the at least parti-cylindrical head of the at least one bearing, the recess having a larger radius of curvature than the head to facilitate rocking therebetween.

19. The railroad car truck of claim 18, wherein the means (i) for rigidly connecting each of the rocker seats to an adjacent pair of collars, includes forming each one of the rocker seats integrally with a pair of collars.

20. The railroad car truck of claim 18, wherein the means (i) for rigidly connecting each of the rocker seats to an adjacent pair of collars, includes a pair of gusset plates rigidly connected between each of the rocker seats and adjacent pair of collars.

21. The railroad car truck of claim 20, wherein the means (i) for rigidly connecting each of the rocker seats to an adjacent pair of collars also includes a second pair of similar collars secured to each of the pair of opposing ends of the tie rods in axial spaced relation from the other pairs of tie rods and rocker seats, and a third gusset plate secured between each of the second pairs of collars and the adjacent rocker seat between the other pair of gusset plates.

* * * * *